US006307813B1

(12) United States Patent
Leggio

(10) Patent No.: US 6,307,813 B1
(45) Date of Patent: Oct. 23, 2001

(54) APPROXIMATE CONVERSATIONAL TIMEPIECE

(76) Inventor: William R. Leggio, 2 Charlton St. (Apt. 11K), New York, NY (US) 10014

( * ) Notice: Subject to any disclaimer, the term of this patent is extended or adjusted under 35 U.S.C. 154(b) by 576 days.

(21) Appl. No.: 08/691,889

(22) Filed: Aug. 1, 1996

(51) Int. Cl.[7] ..... G04B 28/01
(52) U.S. Cl. ..... 368/63
(58) Field of Search ..... 368/80, 221, 75, 368/271, 272

(56) References Cited

U.S. PATENT DOCUMENTS

| | | | |
|---|---|---|---|
| 1,276,344 | | 8/1918 | Gilman . |
| 2,137,646 | | 11/1938 | Dorr et al. . |
| 2,749,627 | | 6/1956 | Jones . |
| 2,837,838 | | 6/1958 | Lewis . |
| 2,853,804 | | 9/1958 | Bengeyfield . |
| 3,911,668 | * | 10/1975 | Beguin ..... 368/80 |
| 4,444,515 | * | 4/1984 | Clark ..... 368/279 |
| 4,500,211 | * | 2/1985 | Hashimoto et al. ..... 368/63 |
| 4,589,779 | * | 5/1986 | Hatta et al. ..... 368/74 |
| 4,799,890 | | 1/1989 | Thompson et al. . |
| 5,050,139 | * | 9/1991 | Oberst ..... 368/19 |
| 5,133,666 | | 7/1992 | Levy . |
| 5,455,808 | | 10/1995 | Grupp et al. . |

* cited by examiner

*Primary Examiner*—Bernard Roskoski
(74) *Attorney, Agent, or Firm*—Amster, Rothstein & Ebenstein

(57) ABSTRACT

A timepiece for exactly indicating the approximate time, has a timepiece face without a minute hand and an indicator for indicating the approximate time in conversational terms. The indicator may be visual or oral. The conversational terms either never indicate the exact numeric time correct to the minute or indicate the exact numeric time correct to the minute only on integral multiples of 15 minutes.

22 Claims, 1 Drawing Sheet

FIG. 1
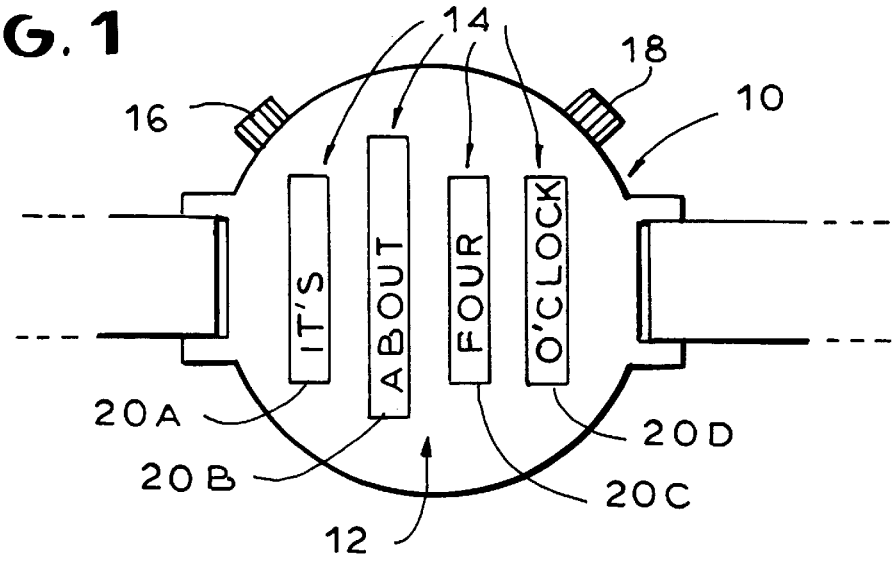
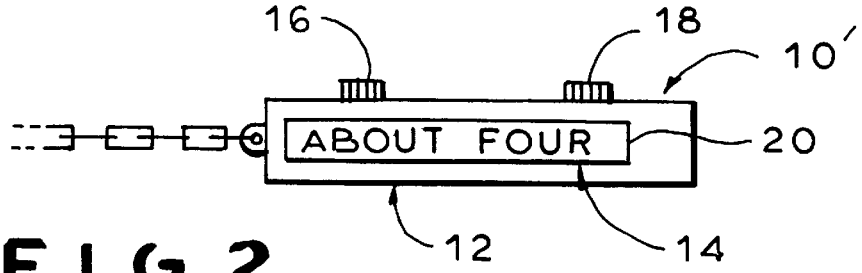
FIG. 2
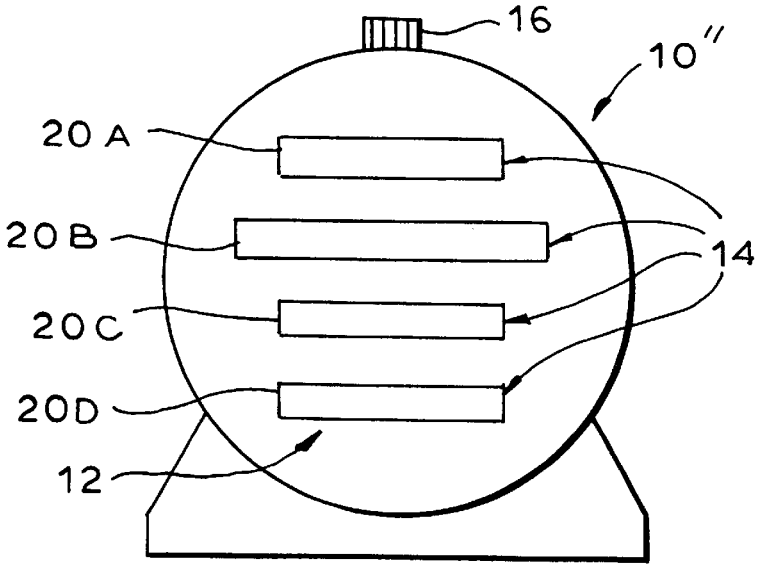
FIG. 3

APPROXIMATE CONVERSATIONAL TIMEPIECE

BACKGROUND OF THE INVENTION

The present invention relates to a timepiece, and more particularly to a novel timepiece which exactly indicates the approximate time but only rarely, if ever, indicates the exact numeric time correct to the minute.

Modern timepieces have become extremely precise within a relatively short period of time. Over the last fifty years, timepieces have progressed from being wound by hand, to wound by wrist movement, to a battery-operated quartz movement, and finally to a movement which daily checks for accuracy with a national time standard and resets itself accordingly.

This enhancement in precision timekeeping has been matched by an increase in the precision in the way time is indicated by the timepiece. The precision of the now popular digital readouts (such as the digital LED readouts) avoid the difficulty in attributing the exact location of analog hands and permit a precise digital time to be conveyed.

Nowadays one is almost ashamed to read the time in an oral conversational term such as "it's about three," "just past three," "a little after three," "almost a quarter past three," "about a quarter after three," between a quarter and half past three," "coming up to half past three," "half past three," and the like. These conversational terms include the exact numeric time to the minute only at integral multiples of 15 minutes—for example, "it's exactly three, it's exactly a quarter past three, it's exactly half past three". Also the words "noon," "midday" and "midnight" are used to describe the appropriate 12 o'clock hour.

While it may be argued that the precision with which we tell time merely reflects the "time is money" business attitude prevalent nowadays, the present invention is based on the belief that, where possible, dealing with time in a less precise way may be psychologically therapeutic.

Accordingly, it is an object of the present invention to provide a timepiece for indicating the approximate time.

Another object is to provide such a timepiece which, in a preferred embodiment, indicates the approximate time, either visually or orally, in conversational terms.

A further object is to provide such a timepiece which, in a preferred embodiment, either never indicates the exact numeric time correct to the minute or indicates the exact numeric time correct to the minute only on integral multiples of 15 minutes.

It is also an object of the present invention to provide such a timepiece which, in a preferred embodiment, uses different terms to tell the same time on different occasions.

It is another object to provide such a timepiece which is inexpensive and easy to manufacture, maintain and use.

SUMMARY OF THE INVENTION

It has now been found that the above and related objects of the present invention are obtained in a time piece for indicating the approximate time. The timepiece comprises a timepiece face without a minute hand, and means for indicating in conversational terms the approximate time.

The indicating means may be visual or oral, and the conversational terms may either never indicate the exact numeric time correct to the minute or indicate the exact numeric time correct to the minute only on integral multiples of 15 minutes. The timepiece may also be without an hour hand.

In a preferred embodiment, on different occasions different conversational terms may be used to describe the same time. In other words, for example, the conversational terms may be "it's coming up on four," "it's almost four," or the like.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein:

FIG. 1 is a top plan view of a first wristwatch embodiment of a timepiece according to the present invention;

FIG. 2 is a fragmentary front elevational view of a second pocket watch embodiment of a timepiece according to the present invention; and FIG. 3 is a front elevational view of a third table clock embodiment of a timepiece according to the present invention.

DETAILED DESCRIPTION OF THE PREFERRED EMBODIMENTS

Referring now to the drawing, and in particular to FIG. 1 thereof, therein illustrated is a timepiece according to the present invention, generally designated by the reference numeral 10. The timepiece 10 is illustrated as a wristwatch, but may be a pocket watch 10' (as in FIG. 2), a table clock 10" (as in FIG. 3) or other conventional form of timepiece. However, the timepiece according to the present invention is intended to indicate the approximate time, but, for the most part, not to indicate the exact numeric time correct to the minute, thereby to minimize time-related stress on the user.

The timepiece comprises a timepiece face, generally designated 12, means 13 behind the face for keeping the exact time, and means for indicating to the user the approximate time in conversational terms, generally designated 14.

The face 12 may or may not have an hour hand (not shown) and may or may not have hours or symbols (not shown) representing the hours disposed about the outer circumstance. However, it is critical that the face 12 is devoid of a minute hand or other representation which would indicate more or less the exact minute of the hour. Note that while the face 12 is devoid of a minute hand, it may have a second hand so that the timepiece is still useful for determining the time in which a pulse is being taken (typically 15 seconds) or other short time intervals (typically a minute or less). In a preferred embodiment, the face 12 is devoid of hour, minute or second hands and, additionally, devoid of any indicia representing the seconds, minutes or hours.

It is possible for the timepiece to indicate the time continuously, as with a conventional timepiece, or to only indicate the time when an actuating means 16 is actuated (as is commonly the case in talking timepieces for the blind, etc.). When the actuating means 16 is actuated (for example, by depression of an actuating switch), the time will be displayed for a predetermined interval (e.g., 15–30 seconds) or spoken once.

The wrist watch 10 and pocket watch 10' of FIGS. 1 and 2, respectively, each include also setting means 18 for originally setting the timepiece or correcting the timepiece thereafter, and the table clock 10" of FIG. 3 will typically also have a setting means on the back face thereof.

In the watch 10 of FIG. 1 and the table clock 10" of FIG. 3, four display areas 20 are shown (which may be of the same or different size), each on a separate line, so that a four segment message may be displayed—for example, "it's" "approximately" "four" "o'clock". In certain instances one of the four display areas 20 may not be utilized at a particular time (due to the "blank" in subgroups B2 and D2, as will become explained hereinafter). The pocket watch of FIG. 2 has only a single display area 20 and thus would be used with a scrolling message appearing in the single area. The conversational terms may be the same regardless of whether the message is given in a plurality of display areas or as one scrolling message.

Where the indicating means 14 requires actuation before indicating the time, the face 12 may be a solid color (such as black) or ornamented, for example, with a design or logo. Where the indicating means 14 is only oral, any design or logo on the face may remain continuously visible on the face, but where the indicating means 14 is at least in part visual, any design or logo normally on the face may be replaced for a brief period of time after actuation with an alphanumeric or alphabetic display indicating the approximate time in the appropriate conversational terms.

Where the indicating means 14 is visual, a brief message of about 3–9 words may appear on the face 12. The visual indicating means 14 may be an LED (light-emitting diode), LCD or like visible means. The visual message of an indicating means 14 may be broken up into several lines or display areas 20 for timepiece size considerations, for ease of visibility, etc. Where the indicating means is oral, the conversational terms for the appropriate time may be generated by a sound-generating chip and speaker within the timepiece upon actuation of the actuating means 16. The indicating means 14 may be both oral and visual, if desired.

A microprocessor chip is used to generate or select the conversational terms appropriate for the approximate time.

By way of example, and not as a limitation thereon, the conversational terms used to describe the time might include the following for any one-hour period (here, the hour from just past three to just past four) with synonymous terms being given in parentheses:

| | |
|---|---|
| 3:01–3:02 | It's about (just about) (approximately) three o'clock |
| 3:03–3:05 | It's just past (just after) (a little after) three o'clock |
| 3:06–3:10 | It's near (coming up to) (a little before) a quarter past three |
| 3:11–3:14 | It's close to (just before) (approximately) (almost) a quarter past three |
| 3:15 | It's exactly ("blank") a quarter past three |
| 3:16–3:17 | It's about (just about) (approximately) a quarter after three |
| 3:18–3:20 | It's just past (just after) (a little after) a quarter past three |
| 3:21–3:25 | It's near (coming up to) (a little before) half past three |
| 3:26–3:29 | It's close to (just before) (approximately) (almost) half past three |

-continued

| | |
|---|---|
| 3:30 | It's exactly ("blank") half past three |
| 3:31–3:32 | It's about (just about) (approximately) half past three |
| 3:33–3:35 | It's just past (just after) (a little after) half past three |
| 3:36–3:40 | It's near (coming up to) (a little before) a quarter to four |
| 3:41–3:44 | It's close to (just before) (approximately) (almost) a quarter to four |
| 3:45 | It's exactly ("blank") a quarter to four |
| 3:46–3:47 | It's about (just about) (approximately) a quarter to four |
| 3:48–3:50 | It's just past (just after) (a little after) a quarter to four |
| 3:51–3:55 | It's near (coming up to) (a little before) four |
| 3:56–3:59 | It's close to (just before) (approximately) (almost) four |
| 4:00 | It's exactly ("blank") four o'clock |

The "blank," of course, is not spoken or displayed.

As can be noted from the above conversational terms, the exact numeric time, correct to the minute, is given, if at all, only on multiples of 15 minutes, and even then preferably without stating the exact number of minutes.

It will be appreciated that the "conversational" terms are the traditional approximative answers given when one is asked to give another person the time. The approximative nature of the description is a critical element to the concept of the timepiece of the present invention because it is in this manner that the timepiece describes time differently than a word-by-word numeric description of the exact time and thus reduces time-related stress.

In a preferred embodiment, the approximative nature of the time is reinforced by using different terms or phrases on different occasions to tell the same time. Thus, the synonymous terms "just past" and "just after" or "almost" and "just before" may be used to tell the same time relative to different hours or portions thereof. Clearly, these are only examples, and other synonymous terms or phrases may be used instead of or in addition to those mentioned above or in TABLE I.

In another preferred embodiment, the approximate nature of the time is reinforced by using the same terms or phrases on different occasions to tell different times. Thus, on one occasion, the term "about" may be used to describe the time interval of one to two minutes after the hour and, on another occasion, the time interval of one to three minutes or even three to five minutes after the hour. The use of the same term to describe different time intervals may vary with the day, the hour or even the portion of the hour, as desired. The object, of course, is that the user is discouraged from associating a given term or phrase (or its synonymous terms or phrases) with a precisely fixed time interval. Such an association would defeat, to some degree, the very purpose of the approximate timepiece of the present invention.

In a most preferred embodiment, the approximate nature of the time is reinforced both by using different terms or phrases on different occasions to tell the same time and by using the same terms or phrases on different occasions to tell different times.

It is believed that by combining the approximate time-telling nature of the basic embodiment with the special features described in connection with the two preferred embodiments immediately above, the user will eventually place less emphasis on the exact time and permit other aspects of life to command greater interest, such as the character and quality of the life.

In functional terms, the timepiece according to the present invention may rely on conventional computer chips designed for predetermined functions. For example, one chip will be the chronometer and perform the timekeeping function, and another chip will be a display or sound-generating chip to display or speak the words. In a preferred embodiment the selection of different conversational terms to describe the same time or the same conversational term to describe different times may be made by a microprocessor chip based on a pattern or by a random selection.

The timepiece may have a replaceable indicating means so that the language of the conversational terms, whether displayed or spoken, may be varied from one linguistic area to another.

By way of example, the words, terms or phrases to be displayed or spoken are divided into four message command groups: message A, message B, message C, and message D, as set forth in TABLE I. Each message command group is preferably associated with a given display area 20A, 20B, 20C or 20D of a visual indicating means 14.

Message command group A consists of various ways to start off an indication of the time. Thus, one might say, "It's . . . ," "It is . . . ," "We're . . . ," or "You're . . ." In an advanced embodiment of the present invention, it may be possible for the user to decide which one or ones of the indicated four terms of message A will be used according to his or her preference.

Message command groups B, C and D are each divided into two subgroups as follows: B1 and B2, C1 and C2, and D1 and D2.

Subgroup B1 sets forth various modifiers which might be used in conversationally stating the various time intervals from 0 to 14 minutes after a quarter hour. The modifiers or terms which are grouped together for a particular time interval are roughly synonymous and, in a preferred embodiment, are substituted for one another at different times, as determined by a microprocessor chip acting on a predetermined pattern or by a random selection, so as to provide a variety of expression. It will be appreciated that different time intervals may be used, and, indeed, the words or phrases used to describe or modify each time interval may be varied. only some suggestions are given herein.

Subgroup B2 gives the three fifteen minute intervals after the hour: "a quarter past," "half past," and "a quarter to."

Subgroup C1 gives the hour (1–11, noon or midday, and midnight).

Subgroup C2 is identical to subgroup B2.

Subgroup D1 is identical to subgroups C1.

Subgroup D2 is either "o'clock" or "blank."

For the sake of economy, subgroups B2 and C2 may access the same area in memory and subgroups C1 and D1 may access the same area in memory. In this manner the demands placed upon the memory of the sound chip may be minimized.

Table II sets forth the allowable permutations of the message command groups. There are three permissible permutations follows:

1. A, B1, C1 and D2:
2. A, B1, C2 and D1; and
3. A, B2, C1 and D2.

To summarize, the present invention provides a timepiece for indicating the approximate time, either visually or orally, in conversational terms. The timepiece never indicates the exact numeric time correct to the minute or indicates the exact numeric time correct to the minute only on integral multiples of 15 minutes. Preferably the timepiece uses different terms to tell the same time on different occasions. The timepiece is inexpensive and easy to manufacture, maintain and use.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims and not by the foregoing specification.

TABLE I

MESSAGE COMMAND GROUPS

| Message A | Message B | | Message C | Message D |
|---|---|---|---|---|
| | | Subgroup B1 | Subgroup C1 | Subgroup D1 |
| a. it's | 0 | a. exactly | a. one | a. one |
| | | b. (blank) | b. two | b. two |
| b. it is | 1-2 | c. about | c. three | c. three |
| c. we're | | d. just about | d. four | d. four |
| | | e. approximately | e. five | e. five |
| d. you're | 3-5 | f. just past | f. six | f. six |
| | | g. just after | g. seven | g. seven |
| | | h. a little after | h. eight | h. eight |
| | 6-10 | i. near | i. nine | i. nine |
| | | j. coming up to | j. ten | j. ten |
| | | k. a little before | k. eleven | k. eleven |
| | 11-14 | l. close to | l. noon (midday) | l. noon (midday) |
| | | m. just before | m. midnight | m. midnight |
| | | n. almost | | |
| | | o. approximately | | |
| | Subgroup B2 | | Subgroup C2 | Subgroup D2 |
| | a. a quarter past | | a. a quarter past | a. o'clock |
| | b. half past | | b. half past | b. (blank) |
| | c. a quarter to | | c. a quarter to | |

TABLE II

ALLOWABLE PERMUTATIONS OF MESSAGE COMMAND GROUPS

| A | B1 | B2 | C1 | C2 | D1 | D2 |
|---|---|---|---|---|---|---|
| x | x | x | x | | | |
| x | x | | | x | x | |
| x | | x | x | | | x |

I claim:

1. A timepiece for indicating the approximate time, said timepiece comprising:

(A) a timepiece face without a minute indicator; and (B) means for indicating the approximate time in conversational terms, each said term reflecting a different fixed period before or after the hour, the period being expressed non-numerically.

2. The timepiece of claim 1 wherein said indicating means is visual.

3. The timepiece of claim 1 wherein said indicating means is oral.

4. The timepiece of claim 1 wherein said timepiece face is without an hour indicator.

5. The timepiece of claim 1 wherein said conversational terms never indicate the exact numeric time correct to the minute.

6. The timepiece of claim 1 wherein said conversational terms indicate the exact numeric time correct to the minute only on integral multiples of 15 minutes.

7. The timepiece of claim 1 wherein on different occasions different conversational terms describe the same time.

8. The timepiece of claim 1 wherein said conversational terms exactly indicate the hour.

9. The timepiece of claim 1 wherein said conversational terms include an exact indication of the hour and, except in a limited number of special circumstances, only an approximate indication of the minute.

10. A timepiece for indicating the approximate time in words, said timepiece comprising:

(A) a timepiece face without a minute indicator; and (B) means for indicating the approximate time in words, said words reflecting a different fixed period before or after the hour, the period being express non-numerically.

11. The timepiece of claim 10 wherein said indicating means is visual.

12. The timepiece of claim 10 wherein said indicating means in oral.

13. The timepiece of claim 10 wherein said timepiece face is without an hour indicator.

14. The timepiece of claim 10 wherein said words never indicate the exact numeric time correct to the minute.

15. The timepiece of claim 10 wherein said words indicate the exact numeric time correct to the minute only on integral multiples of 15 minutes.

16. The timepiece of claim 10 wherein on different occasions different words describe the same time.

17. The timepiece of claim 10 wherein said words exactly indicate the hour.

18. The timepiece of claim 10 wherein said words include an exact indication of the hour and, except in a limited number of special circumstances, only an approximate indication of the minute.

19. A timepiece for indicating the approximate time in words, said timepiece comprising:

(A) a timepiece face without a minute indicator; and (B) means for visually indicating the approximate time in words.

20. The timepiece of claim 1 wherein said means for indicating the approximate time in conversational terms uses at least one word selected from the group consisting of "about," "just about," "approximately," "just past," "just after," "a little after," "near," "coming up to," "a little before," "close to," "just before," and "almost."

21. The timepiece of claim 10 wherein said means for indicating the approximate time in words is only approximate as to the minute.

22. The timepiece of claim 19 wherein said means for visually indicating the approximate time in words is only approximate as to the minute.

* * * * *